United States Patent [19]

Camara et al.

[11] Patent Number: 4,962,928

[45] Date of Patent: Oct. 16, 1990

[54] ANTIVIBRATORY DEVICE FOR SPORTS RACKETS

[76] Inventors: Alpha Camara, c/o F.I. Sciences, 48 rue St. Sebastien, 06410 Biot; Jean-Claude Bianchi, P.O. Box 46, Biot 06410, both of France

[21] Appl. No.: 207,403

[22] PCT Filed: Sep. 9, 1987

[86] PCT No.: PCT/FR87/00348

§ 371 Date: Aug. 1, 1988

§ 102(e) Date: Aug. 1, 1988

[87] PCT Pub. No.: WO88/02271

PCT Pub. Date: Apr. 7, 1988

[30] Foreign Application Priority Data

| | | | |
|---|---|---|---|
| Sep. 30, 1986 | [FR] | France | 86 13956 |
| Sep. 30, 1986 | [FR] | France | 86 13958 |
| Apr. 16, 1987 | [FR] | France | 87 05639 |

[51] Int. Cl.[5] ..... A63B 51/10

[52] U.S. Cl. ..... 273/73 D; 273/73 R

[58] Field of Search ..... 273/73 R, 73 C, 73 D, 273/73 E, 73 G

[56] References Cited

U.S. PATENT DOCUMENTS

| | | | |
|---|---|---|---|
| 763,059 | 6/1904 | Hyde | 273/73 D |
| 4,180,265 | 12/1979 | Staufer | 273/73 D |
| 4,575,083 | 3/1986 | Adam | 273/73 D |
| 4,732,383 | 3/1988 | Ferrari et al. | 273/73 D |

FOREIGN PATENT DOCUMENTS

| | | | |
|---|---|---|---|
| 3123690 | 3/1983 | Fed. Rep. of Germany | 273/73 R |
| 4143674 | 5/1983 | Fed. Rep. of Germany | 273/73 D |
| 3447608 | 7/1986 | Fed. Rep. of Germany | 273/73 D |
| 2056287 | 3/1981 | United Kingdom | 273/73 D |

*Primary Examiner*—Edward M. Coven
*Assistant Examiner*—William E. Stoll
*Attorney, Agent, or Firm*—Pollock, Vande Sande & Priddy

[57] ABSTRACT

The device absorbs vibrations which occur in the strings of a sports racket in order to reduce the risks of articular damage to the player's elbow. It is comprised of an elastomer element (1) having an elongate shape and a small cross-section terminated by spherical protuberances (2) used to tie the element to the strings. The device is provided at its middle with a bulge (3) for centering transversely the device in the strings of the racket and having the function of stiffening the element while increasing locally its linear mass. The device is fixed in the strings by interlacing it by one turn on the bearing strings (4).

13 Claims, 2 Drawing Sheets

ANTIVIBRATORY DEVICE FOR SPORTS RACKETS

FIELD OF THE INVENTION

The invention relates to a device designed to absorb string vibrations during hitting of a ball against the strung surface of tennis or squash rackets, such vibrations as provoke articular lesions resulting in "tennis elbow."

BACKGROUND OF THE INVENTION

It is a well-known fact that, by introducing a piece or strip of viscoelastic elastomer material onto the frame or strings of a racket, one can influence vibratory phenomena. However, such antivibration devices used to date have exhibited one or more of the following defects:

(1) ineffectiveness due to their positioning on the frame or in the racket strings
(2) difficulties involved in their installation and fastening which result in their lack of cohesion to the strung hitting surface during ball impact
(3) complexity of utilization
(4) interference of the over-sized device with desired trajectory of the ball The device disclosed in French Patent No. 2,585,256 of July 29, 1985, in addition to its uncertain lateral deportment during repeated impact, offers no permanent cohesion during vibratory modes on the strung hitting surface, due to the rigidity of its basic material as well as to the limited number of strings with which it is in direct contact. Its excessive width necessarily compensates for the minimal thickness required in order to fix it onto the strung hitting surface, but this means that the device is too wide to be interlaced into the meshed surface of the racket, particularly close to the area of impact where maximum string reverberation occurs. The rigidity of this device also tends to modify the central ball-impact zone and, being nonretractable, it contributes to deflecting the ball in the event of direct contact.

The device disclosed in French Patent No. 2,585,257 based on French Patent No. 1,398,833 of Mar. 31, 1964, is probably too bulky to be really effective, since it is fixed to only one square of the meshed racket surface. Moreover, its sprue is stretched out by compression on the periphery of the racket surface, which renders the device ineffective in vibratory modes.

SUMMARY OF THE INVENTION

The presently proposed device is designed to remedy the above-cited defects by dealing in a coherent manner with all vibratory phenomena present on the strung hitting surface.

In its preferred embodiment, the device is composed of a length of flexible elastomer material which is interlaced into the strung surface of the racket along any particular line, but without modifying either the geometry or the exerted stress on the racket surface.

The inherent flexibility and elasticity of the device also permits a different positioning, which is effected by entwining it once around the strings of the hitting surface. The device is fitted at each end with spherical protuberances or bulges which serve as coupling elements either fastened into the racket strings or inserted into the recessed housings intended for them around the inner rim of the racket frame. At least one protuberant couple in the middle of the device is designed to both tauten it and to locally increase its mass per unit length, thereby contributing to optimal absorption and damping of vibrations on the strung hitting surface of the racket.

In its preferred embodiment, the device is composed of a silicone-based or natural rubber-based elastomer material which is both tear-resistant and viscoelastic, thereby providing good structural absorption of vibratory phenomena. The device as such can be hollow, if desired.

During the multiple contacts of the device with strings involved in reverse bending vibrations (rebound), its longitudinal elastic segment contributes to ensuring that the device remains in perfect cohesion with the strung hitting surface and in constant contact with the strings. Moreover, its viscosity contributes to checking string movement by converting such vibrations into heat which is convection-dissipated upon contact with the surrounding air.

BRIEF DESCRIPTION OF THE DRAWINGS

In order that the invention may be more clearly understood, reference will now be made to the accompanying drawings, wherein an embodiment of the invention is shown for purposes of illustration, and wherein.

DESCRIPTION OF PREFERRED EMBODIMENT

Figure 1:
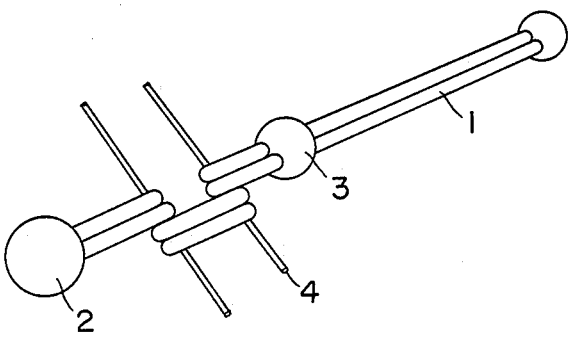
FIGS. 1 and 2 show the longitudinal element with its protuberant spheres at both ends, in perspective view and front elevation, respectively.
Figure 2:
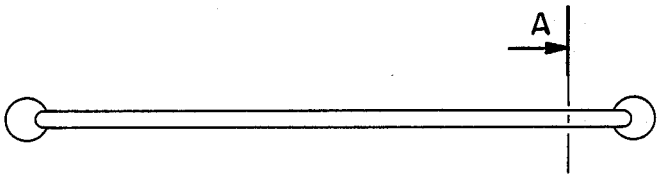
Figure 3:
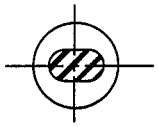
FIG. 3 is a section view at plane A in FIG. 2.

FIGS. 1 and 2 display the longitudinal element (1) constituting the anti-vibration device according to the invention with its protuberant spheres at both ends, while FIG. 3 illustrates the cross-section of the device at line A of FIG. 2.

Figure 4:
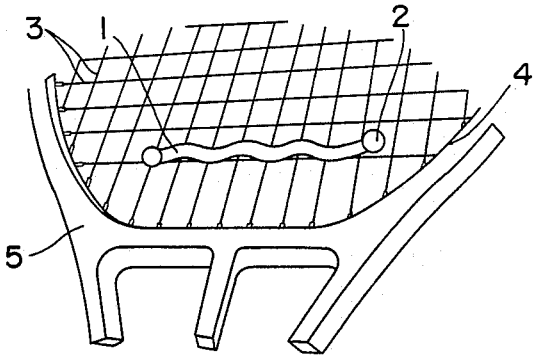
FIG. 4 shows one possible positioning of the device in the strung hitting surface of the racket.

FIG. 4 shows the device woven into the strung hitting surface of the racket along a transverse axis. The racket frame (5) is equipped with recessed housings (4) where the spherical coupling protuberances (2) can be fastened.

Figure 5:
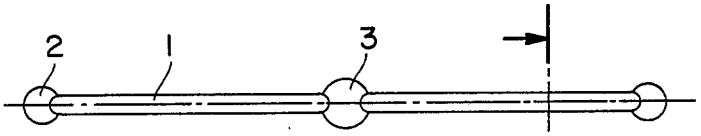
FIG. 5 is a front elevation of the device and its central protuberance.

FIG. 5 shows a segment of the device composed herein of two cylindrical forms placed side by side in order to provide the flexibility required to entwine the narrow segment around or to interlace it under and over the racket strings without distending or slackening them. The coupling element (3) in this segment is centered in the middle of the device in order to tauten it locally (1) and increase its mass per unit length.

Figure 6:
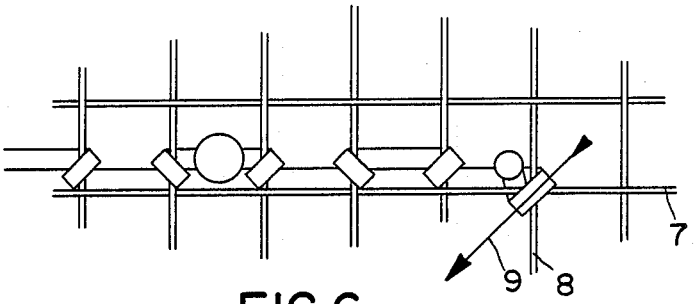
FIG. 6 illustrates the steps involved in fastening the device to the racket.

FIG. 6 shows how the device is woven into the strung surface of the racket around the intersecting points of two strings in the following manner:

(1) The device is introduced against and in the same direction as a first, transversal string (7);
(2) it is then wound around and under a second, longitudinal string (8) at a chosen crossing point of the said first and second strings while at the same time folding it up and over the said string;

(3) it is then repassed under the crossing point so that the couple sphere (3) emerges between the first string (7) and the segment of the device which is already engaged in the strings.

Figure 7:
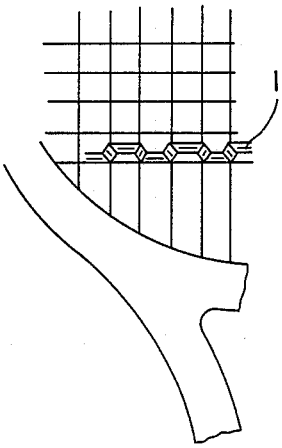
FIG. 7 is a front-side view of the device as positioned within the racket strings.

FIG. 7 shows the device in position in the strung surface of the racket, entwined around the strings after having been once folded over each string, and in a transversal direction to the axis of the racket shaft.

Figure 8:
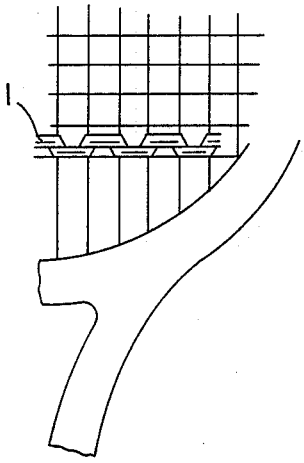
FIG. 8 is a reverse-side view of the device as positioned within the racket strings.

FIG. 8 shows the reverse side of the racket with the device entwined around the strings of the hitting surface.

The device according to the invention can be most simply executed in flexible molded elastomer material, either by injection or by compression, and is particularly designed to reduce vibration in tennis rackets. It can be wound around or woven between the strings of a tennis racket in transversal, diagonal or longitudinal directions or along a curve.

It is to be understood that the invention has been described merely by way of example and that its proportions remain relative to the dimensions of the meshed hitting surface of the racket itself. It is also to be understood that neither the number of times which the device is wound around the racket strings nor the different variations in form of its possible constituent elements constitute limitations on the scope of the invention.

We claim:

1. Anti-vibratory device for a sports racket, comprising an elastomer strip element alternately interlaced onto strung meshing of a hitting surface of said racket and including spherical protruberances at each end, said element forming a cohesive unit consisting of (a) an elongated narrow segment (1) which ensures its cohesion to said hitting surface of said racket when said surface rebounds after contact with a ball, such cohesion being accomplished by successive weaving of said interlaced strip element over and under specific racket strings;

(b) protuberant coupling elements (2) at each end of said strip element which ensure coupling of respective strings by folding the strip around the crossing points between longitudinal and transverse strings of said hitting surface; and (c) at least one central coupling element (3) situated in the middle of said device in order to tauten it and hence locally increase its mass per unit length.

2. Device according to claim 1, wherein said spherical protuberances laterally secure said element to said racket.

3. Device according to claim 1, wherein said end protuberances (2) are fastened to recesses located along an inside rim of a frame (5) of said racket.

4. Device according to claim 1, wherein said element is made of a flexible material enabling it to be wound around longitudinal and transversal cross-sections of strings of said racket without modifying in any way the geometry, stress or surface relief of said strings.

5. Device according to claim 1, wherein said elongated narrow segment (1) is of an oval shape, thereby preventing ball deflection after impact.

6. Device according to claim 1, wherein said element is fixed to said hitting surface by knotting its spherically protuberant extremities around the cross-section of two strings by positioning said strip against and along a first, transverse string (7), weaving said strip under a second, longitudinal string (8) at a selected point of intersection of said first and second strings while at the same time folding said strip back and over second string at a 45° angle to said first and second strings, and then repassing said element under said point of intersection so as to position said protuberance (2) between said first string (7) and the second of said narrow segment which is already in place.

7. Device according to claim 1, wherein said central coupling element (3) comprises a sphere which, at the moment when the device is introduced into the racket strings, is level with a longitudinal symmetry axis of said racket corresponding to a zone of maximum pulsation for all vibratory modes on said hitting surface.

8. Device according to claim 1 wherein a median section of said device is substantially denser than said narrow segments, to increase the absorption potential of said device in a maximum pulsation zone.

9. Device according to claim 1, wherein said narrow segment is flexible enough to allow it to be wound in a longitudinal or transversal manner, and the inertia of its segments is so limited that it can be interlaced at least twice around a same string within at least one meshed square on said hitting surface.

10. Device according to claim 1, wherein said narrow segment (1) is composed of a plurality of parallel longitudinal strands.

11. Device according to claim 1, wherein said central coupling element (3) is spread in order to be in contact with at least one string on said hitting surface.

12. Device according to claim 1, wherein said narrow segment is sufficiently flexible to be applied around a single string, whose extremities are also knotted.

13. Device according to claim 18, wherein said device is fixed in said hitting surface by placing said narrow segment (1) above several longitudinal strings and introducing each of the extremities under a single transversal string.

* * * * *